US005885716A

United States Patent [19]

Nagasawa et al.

[11] Patent Number: 5,885,716

[45] Date of Patent: Mar. 23, 1999

[54] MATERIAL AND PROCESS FOR FORMING COMPOSITE FILM

[75] Inventors: Hiroshi Nagasawa, Hirakata; Masami Nakamoto, Takarazuka, both of Japan

[73] Assignees: Osaka Municipal Government; Tomoe Works Co., Ltd., both of Osaka-fu, Japan

[21] Appl. No.: 907,814

[22] Filed: Aug. 14, 1997

[51] Int. Cl.[6] ..... B32B 9/00

[52] U.S. Cl. ..... 468/469; 427/229; 427/240; 427/421; 427/428; 427/429; 427/430.1; 427/435; 428/471; 428/472.2; 428/702

[58] Field of Search ..... 427/384, 385.5, 427/388.6, 229, 240, 421, 428, 424, 430.6, 435; 428/469, 471, 472.2, 702

[56] References Cited

U.S. PATENT DOCUMENTS

| | | | |
|---|---|---|---|
| 4,649,086 | 3/1987 | Johnson | 427/564 X |
| 4,851,153 | 7/1989 | Kono et al. | 428/520 X |
| 5,412,278 | 5/1995 | Iwasaki | 427/126.3 |

*Primary Examiner*—Michael Lusignan
*Attorney, Agent, or Firm*—Knobbe, Martens, Olson & Bear, LLP

[57] ABSTRACT

Using a material comprising a metal organic compound and an inorganic filler, a composite film is obtained by coating a substrate with said material and heat-treating the coating. The obtained composite film improves the properties of the substrate.

6 Claims, No Drawings

MATERIAL AND PROCESS FOR FORMING COMPOSITE FILM

FIELD OF THE INVENTION

The present invention relates to a novel material and process for forming a composite film. The present invention further relates to a galling-resistant coated article.

BACKGROUND OF THE INVENTION

Various metal composite films (hereinafter referred to as "composite films") are developed for improving the properties of substrates or imparting functions to the substrates. Among others, composite films comprising a metal and an inorganic filler or fluorine resin filler are developed for improving the corrosion resistance, abrasion resistance, self-lubricity, adhesion, decorativeness, etc. of the surfaces of metal substrates.

Conventionally, a composite film is formed on a substrate by an electroplating process using a plating solution to which a filler has been dispersed for incorporating the filler into the metal film when the metal is deposited on the substrate.

However, since the filler is used as dispersed in the plating solution, fillers chemically reactive with the plating solution or those easily precipitated because of their excessive specific gravity are not usable in the above electroplating process. As a result, the type of filler that can be used is very restricted.

Further, since the proportion of the filler in the plating solution is difficult to change greatly, the formulation of the composite film to be formed can not be controlled as desired. Moreover, the above process is not suitable for commercial-scale operations from the viewpoint of reproducibility. In particular, plating solutions of non-uniform system are very difficult to control and thus are scarcely put to practical use.

Fasteners such as bolts, nuts and washers used for water conduits, gas conduits, plant facilities and the like suffer galling when tightened under severe conditions. Consequently, the tightened connection can not be released, and the fasteners as such have to be cut off. For preventing such troubles, the threads of the fasteners are surface-treated by wet coating (using an oil, etc.), plating, ceramic coating, resin coating or the like in order to prevent galling.

However, when the fasteners are wet-coated, earth and sand are likely to adhere to the coated surface during tightening, impairing the workability. Further, when the wet-coated fasteners are used for water supply conduits, the coating composition may dissolve in and 25 contaminate supplied water. The conventional non-composite plating does not have satisfactory abrasion resistance or durability, and thus easily peels off during the first tightening operation. Therefore, the contemplated galling preventing effect is not achieved. Moreover, both the above wet coating and plating are unsatisfactory in weather resistance and have the drawback that corrosion and other problems occur in the outdoors or in severe environments of high temperature and high humidity. The ceramic coating and resin coating are damaged by the pressure, friction and the like during tightening, failing to exhibit satisfactory galling preventing effect.

In addition, galling is likely to cause also in grinding members such as guide rails for mechanical parts and bearings for rotating parts. In particular, no methods have been found which can effectively prevent galling caused by heavy loads in vacuums which do not permit the use of lubricants, grease, etc., or in semiconductor production facilities wherein prevention of contamination is required.

SUMMARY OF THE INVENTION

The main object of the present invention is to provide a material for forming a composite film capable of imparting excellent properties to substrates. Another object of the present invention is to provide a coated article which has galling resistance and excellent durability.

The present inventors conducted extensive research in view of the problems of the prior art, and found that the above objects can be achieved by forming a film from a material of a specific formulation. The present invention has been accomplished based on this novel finding.

The present invention provides the following material and process for forming a composite film and the following galling-resistant coated article.

1. Material for forming a composite film comprising a metal organic compound and an inorganic filler
2. Process for forming a composite film comprising the steps of coating a substrate with the above material and heat-treating the coating
3. Galling-resistant coated article wherein a part or the whole of the substrate is coated with a composite film consisting substantially of an inorganic filler and a metal component remaining after the heat decomposition of a metal organic compound

DETAILED DESCRIPTION OF THE INVENTION

The metal organic compound for use in the material for forming a composite film of the invention is not limited specifically insofar as it can be thermally decomposed to form a composite film. Usable metal organic compounds include those known and those commercially available, for example, carboxylic acid salts, mercaptide compounds, amine compounds, metal alkoxides and the like. Various chelate compounds such as metal acetylacetonate are also usable in the present invention. These metal organic compounds can be used singly or as a mixture of two or more.

Among these metal organic compounds, preferably usable in the present invention are carboxylic acid salts such as naphthenic acid salts, oleic acid salts, palmitic acid salts, octylic acid salts, benzoic acid salts, stearic acid salts, paratoluylic acid salts and decanoic acid salts. Among the carboxylic acid salts, most preferable are salts of straight-chain carboxylic acids (in particular those having 6 to 30, preferably 10 to 18 carbon atoms).

The metal component in the metal organic compounds is not limited specifically and includes, for example, Au, Ag, Pt, Rh, Cu, Ru, In, Sn, Ni, Cr, Zn, Pb and the like. At least one of these metals can be properly selected to form a desired composite film. For example, for forming a composite film comprising silver as the metal component, usable metal organic compounds include silver 2-ethylhexanoate, silver benzoate, silver decanoate, silver stearate, silver oleate, silver naphthenate and the like. For forming a composite film comprising copper as the metal component, copper hexanoate, copper palmitate, copper naphthenate and the like are usable. For forming a composite film comprising tin as the metal component, tin 2-ethylhexanoate, tin naphthenate and the like are usable. Further, gold mercaptide compounds, platinum amine compounds and the like can be selected according to the desired metal component. In particular, when preparing a galling-resistant coated article, metal organic compounds comprising Pb, Ag, Cu or the like as the metal component (such as silver oleate, silver stearate and lead naphthenate) are more preferably usable.

According to the present invention, an alloy composite film comprising two or more metal components can be prepared using two or more of the above metal organic components. For example, silver stearate can be used in combination with lead naphthenate to form a composite film comprising a silver-lead alloy.

The inorganic filler can be properly selected according to the metal organic compound to be used in combination, the properties of the substrate and other factors. Usable fillers are oxides such as $Al_2O_3$, MgO, $TiO_2$, $ZrO_2$, $ThO_2$, $Fe_2O_3$, $SiO_2$, $Cr_2O_3$ and $CeO_2$, carbides such as SiC, $B_4C$, $Cr_3C_2$, TaC, WC, $ZrC_2$ and TiC, nitrides such as BN, borides such as $Cr_3B_2$ and $ZrB_2$, inorganic materials such as carbons (including diamond, graphite, etc.), kaolinite, mica, talc and glass. These inorganic fillers can be used singly or as a mixture of two or more. When preparing a galling-resistant coated articles, $Al_2O_3$, MgO, BN, kaolinite, mica, talc and the like are particularly preferred.

The average particle size of the inorganic filler may be properly determined according to the intended use of the final product and other factors, and is usually about 1 to 50 $\mu$m, preferably about 1 to 10 $\mu$m. The particle of the inorganic filler may have a spherical, fibrous, irregular or like shape.

The mixing ratio of the metal organic compound to the inorganic filler can be properly determined according to the intended use of the final product and other factors. For example, when preparing the galling-resistant coated article, the amount of the inorganic filler is about 1 to 50 wt. parts, preferably about 3 to 20 wt. parts, more preferably about 5 to 10 wt. parts, per 100 wt. parts of the metal organic compound.

The material for forming a composite film according to the present invention may contain, in addition to the metal organic compound and inorganic filler, a third component, for example a resin such as polyvinyl alcohol, a surfactant or the like within the range which does not impair the effect of the present invention. Further, water, solvent or the like may be contained when necessary, as described below.

The process for forming a composite film according to the present invention comprises the steps of coating a substrate with the material for forming a composite film and heat-treating the coating. When the metal organic compound is liquid, it is used as such or as diluted with an organic solvent such as n-hexane, toluene, chloroform or the like. The inorganic filler is added to the diluted or undiluted metal organic compound, and the mixture is applied to the substrate by a known coating or printing method such as spin coating, brushing, spray coating, silk screening, dip coating, roll coating or the like to form a coating film.

When the metal organic compound is solid (such as powder), it may be dissolved in a suitable solvent (such as toluene, chloroform, n-hexane or a terpene (e.g., turpentine oil or terpineol)) and mixed with the inorganic filler, or dispersed (in water or an aqueous solvent) together with the filler using a suitable surfactant (such as nonionic surfactant). Then, the obtained mixture is applied to the substrate. Alternatively, the powdery mixture of the compound and filler may be applied as such. It is also possible for the powdery mixture to be melted and softened by heating and then applied to the substrate. In these cases, the substrate can be partially coated by silk screening or other processes.

The film thickness may be determined according to the intended use of the final product and other factors. For example, when used for a galling-resistant coated article, the material is applied so as to form the final composite film with a thickness of about 0.5 to 10 $\mu$m, preferably about 1 to 5 $\mu$m.

After coating the substrate, the coating is dried when necessary. The drying temperature may be determined according to the properties of the coating film and other factors. For example, the coating may be air-dried, allowed to dry, or dried by heating at 150° C. or less (preferably at 50° to 100° C.).

Subsequently, the coating is heat-treated to thermally decompose the metal organic compound. The temperature for the heat treatment may be suitably determined according to the type of the metal organic compound, temperature resistance of the substrate and other factors. For example, when the substrate is a metal or alloy, the heat treatment temperature is usually 700° C. or less, preferably 500° C. or less. The atmosphere for the heat treatment is not limited specifically insofar as the desired film can be formed. For Example, an oxidizing atmosphere or a reducing atmosphere can be employed according to the type of the metal organic compound and other factors. If necessary, the treatment may be carried out first in an oxidizing atmosphere and then in a reducing atmosphere. After the heat treatment, the coating is allowed to cool or quenched by a conventional process. In the composite film according tθ the present invention, a part of the metal organic compound may remain as such within the range which does not impair the effect of the invention.

The substrate for use in the present invention is not limited specifically insofar as it is resistant to the heat treatment and the like, and includes various materials such as metals, alloys, ceramics and plastics, which can be used as such. Usable substrates for preparing a galling-resistant coated article include tension-resistant steel, stainless steel, titanium alloy and the like.

The article of the galling-resistant coated article of the invention includes all of those which are required to be galling-resistant. The galling-resistant coated article of the invention is advantageously usable as a fastener, grinding member, or the like.

Examples of the fasteners are various bolts, nuts, washers, tapping screws and other members which have a threaded rod or hole. When the fastener is a combination of a bolt and nut, the threaded and flat surfaces of the nut are coated with the material for forming a composite film, and the coating is heat-treated. Optionally, the film may be formed on the thread surface of the bolt.

The grinding member includes, for example, guide rails for mechanical parts, bearings for rotating parts and the like. The material for forming a composite film is applied at least to the grinding portion of these members, and the coating is heat-treated.

In the thus obtained galling-resistant coated article, a part or the whole of the substrate is coated with a composite film consisting substantially of the inorganic filler and the metal component remaining after the heat decomposition of the metal organic compound. The composite film of the invention may contain, in addition to the inorganic filler and metal component, undecomposed part of the metal organic compound within the range which does not impair the effect of the invention.

Using the material for forming a composite film according to the present invention, the inorganic filler can be selected from a wide range, and the proportion of the filler can be changed as desired, unlike in the conventional plating process. Also, the film thickness can be controlled as desired.

Accordingly, the properties of the surface of the substrate (such as corrosion resistance, abrasion resistance, self-lubricity, adhesion, decorativeness, etc.) can be suitably improved according to the intended use of the final product.

In particular, the material of the invention is preferably usable for preparing a galling-resistant coated article. As opposed to the plating, the material of the present invention can be applied to substrates of any shape or size, and can form a composite film on a part of the substrate. Further, use of the material of the present invention enables coating of a high ionization tendency metal with a low ionization tendency metal and coating of a light metal such as aluminum with a high melting point metal, which have been difficult to achieve by the conventional plating process.

Unlike the conventional plating process, the process of the invention does not cause environmental pollution with mercury, cyan, etc., since the byproduct of the process of the invention is only a slight amount of carbon dioxide or like heat decomposition products. Further, the process of the invention does not necessitate a treating vessel containing a metal ion solution as used in the plating process. Accordingly, the process of the invention, which can be carried out without using large-scale equipment, is advantageous in view of costs.

Further, the galling-resistant coated article of the invention is effectively prevented from galling, since the composite film formed thereon is integrated with the substrate. Said article has such high durability that it is resistant to six or more tightening operations under specific conditions. Moreover, because of its high heat resistance, etc., said article is usable in outdoors, chemical plants or the like in which said article is exposed to high temperatures. Further, unlike the conventional wet coating, the dry film formed on the article does not cause water or soil pollution.

EXAMPLES

Example 1

Using polyoxyethylene sorbitan oleyl ether (2 wt. %) as a nonionic surfactant, powdery silver acetate with an average particle size of 100 μm (20 wt. %) and powdery alumina with an average particle size of 5 μm (10 wt. %) were dispersed in kerosine (balance) to prepare a material for forming a composite film.

A brass decorative fitment for furniture was brush-coated with the above material, and the coating was dried in a drier at 100° C. and heat-treated in an electric oven at 400° C. The obtained silver composite film (1 μm in thickness) was a satin-finished firm film.

Example 2

Powdery mica with an average particle size of 20 μm (20 wt. %) was added to liquid tin 2-ethylhexanoate (80 wt. %). The mixture was stirred to give a material for forming a composite film.

The obtained material was diluted with toluene, and applied using an air brush to the surface of a grinding member (rail) made of ordinary steel. The coating was air-dried at room temperature and heat-treated in an electric oven at 350° C. in a reducing atmosphere of hydrogen stream. A satin-finished firm tin composite film (2 μm in thickness) was thus obtained which had a surface with good smoothness.

Example 3

Using polyoxyethylene sorbitan oleyl ether (2 wt. %) as a nonionic surfactant, powdery silver stearate with an average particle size of 100 μm (50 wt. %) and flaky glass with an average particle size of 30 μm (5 wt. %) were dispersed in water (balance) to prepare a material for forming a composite film.

The internal surface of a stainless steel part was dip-coated with the above material, and the coating was dried in a drier at 100° C. and heat-treated in an electric oven at 350° C. A highly corrosion-resistant silver composite film (5 μm in thickness) was thus formed on the internal surface of the part.

Example 4

Copper oleate with an average particle size of 100 μm (50 wt. %) and kaolin (an amount varying from 2 to 25 wt. %) were dispersed in linseed oil (balance) to prepare several types of materials for forming composite films.

A glass substrate was coated with each of the above materials by silk screening, and the coating was dried at room temperature for one day and heat-treated in the air in an electric oven at 350° C. Subsequently, hydrogen gas was introduced into the oven to make a reducing atmosphere, and then the coating was allowed to cool. Copper composite films (1 μm in thickness) were thus obtained which had different resistance values according to the kaolin concentration and film thickness.

Example 5

Silver oleate with an average particle size of 100 μm (50 wt. %), mica with an average particle size of 5 to 10 μm (10 wt. %) and turpentine oil (balance) were mixed together to prepare a material for forming a composite film.

A thread surface of a stainless steel bolt was brush-coated with the above material. The coating was dried at 60° C. for 1 hour, heat-treated in the air in an electric oven at 350° C. and allowed to cool.

A bolt coated with a silver composite film (2 μm in thickness) was thus obtained. The obtained bolt was subjected to a heavy load repetitive test and proved to have six or more times the galling resistance of a bolt coated with silver alone.

Example 6

Powdery silver stearate with an average particle size of 100 μm (60 wt. %), liquid lead naphthenate (10 wt. %), boron nitride (BN) with an average particle size of 10 μm (5 wt. %) and polyvinyl alcohol with a polymerization degree of 500 (1 wt. %) were dispersed in terpineol (balance) to prepare a material for forming a composite film.

The above material was applied using a roll brush to a titanium grinding member inside a plain bearing. The coating was dried in a drier at 100° C. and heat-treated in an electric oven at 350° C. A silver-lead alloy composite film (2 μm in thickness) having a high abrasion resistance was thus formed on the grinding member.

We claim:

1. A galling-resistant coated article comprising:

a substrate requiring galling resistance; and a single-layer composite film formed on the substrate for improving galling resistance of the substrate, said single-layer composite file consisting essentially of an inorganic filler and a metal and formed by coating the substrate with a composition comprising a metal organic compound and an inorganic filler and then heating the coated substrate to decompose the metal organic compound.

2. A galling-resistant coated article according to claim 1 wherein the metal organic compound is at least one member selected from the group consisting of carboxylic acid salts, mercaptide compounds and amine compounds.

3. A galling-resistant coated article according to claim 1 wherein the metal organic compound is at least one chelate compound.

4. A galling-resistant coated article according to claim 2 or 3 wherein the metal component in the metal organic compound is at least one member selected from the group consisting of Au, Ag, Pt, Rh, Cu, Ru, In, Sn, Ni, Cr, Zn and Pb.

5. A galling-resistant coated article according to claim 1 wherein the inorganic filler is at least one member selected from the group consisting of $Al_2O_3$, MgO, $TiO_2$, $ZrO_2$, $ThO_2$, $Fe_2O_3$, $SiO_2$, $Cr_2O_3$, $CeO_2$, SiC, $B_4C$, $Cr_3C_2$, TaC, WC, TiC, BN, $Cr_3B_2$, carbon, kaolinite, mica, talc and glass.

6. A galling-resistant coated article according to claim 1 wherein the composition comprises 1 to 50 wt. parts of the inorganic filler per 100 wt. parts of the metal organic compound.

* * * * *